United States Patent [19]

Kade et al.

[11] Patent Number: 5,050,317

[45] Date of Patent: Sep. 24, 1991

[54] DRYING END FOR A MACHINE FOR MANUFACTURING FIBER WEBS

[75] Inventors: Werner Kade, Neenah, Wis.; Johann Preisetanz; Georg Kugler, both of Heidenheim. all of Fed. Rep. of Germany

[73] Assignee: J. M. Voith G.m.b.H., Fed. Rep. of Germany

[21] Appl. No.: 442,547

[22] Filed: Nov. 28, 1989

[30] Foreign Application Priority Data

May 20, 1989 [DE] Fed. Rep. of Germany ... 8906273[U]

[51] Int. Cl.[5] ..... F26B 11/02

[52] U.S. Cl. ..... 34/117; 34/115

[58] Field of Search ..... 34/116, 123, 117, 111, 34/115

[56] References Cited

U.S. PATENT DOCUMENTS

| | | | |
|---|---|---|---|
| 1,656,853 | 1/1928 | Bean . | |
| 3,868,780 | 3/1975 | Soininen et al. | 34/116 |
| 4,359,827 | 11/1982 | Thomas | 34/116 X |
| 4,483,083 | 11/1984 | Chance | 34/116 X |

*Primary Examiner*—Henry A. Bennet

*Attorney, Agent, or Firm*—Ostrolenk, Faber, Gerb & Soffen

[57] ABSTRACT

A drying end which comprises a plurality of drying groups. Referring to FIG. 2, each drying group has its own endless support belt (171–175) which travels together with the web alternately over drying cylinders (101–138) and guide rollers. In each drying group, at least some of the drying cylinders lie in a row of cylinders (161–168) which is arranged approximately vertically. Within the first drying group (160/161) the web travels downward through a vertical cylinder row (161), the lower side of the web contacting the cylinders. In the second drying group (162/163), the web first of all travels upward, the upper side of the web contacting the cylinders. At least two drying groups have two vertical cylinder rows (162–167). Referring to these later two groups, the rows of guide rollers in one drying group are arranged outside the corresponding cylinder rows, and in the other drying group the guide rollers are arranged inside the cylinder rows.

15 Claims, 2 Drawing Sheets

DRYING END FOR A MACHINE FOR MANUFACTURING FIBER WEBS

BACKGROUND OF THE INVENTION

1. Field of the Invention

The present invention relates to a drying end for a machine for the manufacture of fiber webs, for instance paper webs, having a plurality of heatable drying cylinders. The drying end is divided into a plurality of drying-cylinder groups ("drying groups"). Each of these drying groups has an endless support belt of its own which travels, together with the web to be dried, over the drying cylinders and guide rollers. In this connection, the fiber web comes into direct contact with the cylinders while the support belt comes into direct contact with the guide rollers.

The invention relates more particularly to a drying end in which, at least in a substantial proportion of the drying groups, the drying cylinders are arranged in a row which is at least approximately vertical.

2. Background Art

A relevant drying end is known from U.S. Pat. No. 3,868,780. In FIG. 9 of that U.S. patent, each drying group consists of only a single row of cylinders, and each group of cylinders has an endless support belt of its own. In other figures of that U.S. patent, however, so-called double-row drying groups are also shown. For example, FIG. 2 shows a double-row drying group with drying cylinders arranged vertically one above the other. In this drying group, the fiber web to be dried first travels downward through the first row of cylinders and then upward through the second row of cylinders. Naturally, in all cases, only one of the two sides of the web can come into contact with the drying cylinders in such a double-row drying group.

In FIG. 5 and 7, one such double-row drying group is followed by a second double-row drying group. In the second drying group, the web passes first in an upward direction through the first row of cylinders and then in a downward direction through the second row of cylinders. In this way, the other side of the web comes into contact with the drying cylinders in the second drying group so that overall uniform drying on both sides of the web can be obtained. The arrangements in FIGS. 5 and 7 (as well as in FIG. 8) have, however, the disadvantage that the two double-row drying groups are arranged with one shifted vertically with respect to the other.

This disadvantage is avoided in the aforementioned FIG. 9 of U.S. Pat. No. 3,868,780. In that case, the following is provided: In the first drying group, which has only a single row of cylinders, the fiber web travels downward over the drying cylinders, one side of the web contacting the drying cylinders. In a subsequent second drying group, which also has only a single row of cylinders, the fiber web passes upward over the drying cylinders, whereby the other side of the web contacts the drying cylinders. Thus the two sides of the web are alternately guided over the cylinders of, in each case, one row of cylinders, and this process is continued several times in the arrangement in FIG. 9.

One disadvantage of this arrangement is that in the first drying group, the side of the web which was previously the upper side comes into contact with the drying cylinders and, for this reason, the guide rollers which feed the web of paper directly to the following drying cylinders lie on the side of the drying cylinders which is remote from the press end. This is unfavorable because, in the event that the paper web tears, the broke drops down onto a subsequent portion of the support belt rather than directly onto the basement floor. These problems should be avoided, particularly in the first row of cylinders, since broke is produced much more frequently in the first drying group than in the following drying group.

A further disadvantage is that each drying group has only a single row of cylinders. For this reason, there must be a relatively large number of drying groups, support belts, tensioning rollers and adjustment rollers.

SUMMARY OF THE INVENTION

In view of the foregoing problems of the prior art, the principal object of the present invention is to further improve the drying ends known to the art so that the following different requirements can be satisfied simultaneously:

1. Any resultant broke should be removable in as unimpeded a fashion as possible. This applies primarily to the first drying group, but it is also desirable for the following drying groups.

2. The number of drying groups should be as small as possible. Preferably, the two sides of the web should come alternately into contact with the drying cylinders.

3. The following drying groups should all be located at least approximately at the same height.

These objects can be achieved by a drying end for a machine for manufacturing fiber webs, for instance paper webs, wherein:

(a) the drying end comprises a plurality of heatable drying cylinders arranged to form a plurality of drying groups, with at least one guide roller arranged between every two drying cylinders;

(b) each drying group has a respective endless support belt for guiding the fiber web, which travels alternately over the drying cylinders and over the guide rollers so that the fiber web comes into direct contact with the cylinders;

(c) within each drying group, at least some of the drying cylinders are arranged to form a cylinder row which is arranged at least approximately vertically;

(d) in a first drying group having a first support belt and being arranged where the fiber web enters the drying end, the fiber web travels downward through a first substantially vertical cylinder row, a lower side of the web contacting the drying cylinders, and an upper side of the web contacting the support belt;

(e) in a second drying group, having a second support belt and being arranged directly behind the first drying group, the fiber web travels upward through a second substantially vertical cylinder row, the upper side of the web contacting the drying cylinders., and the lower side of the web contacting the second support belt; and (f) the drying end includes at least two directly adjacent double-row drying groups, the guide rollers in one of said double-row drying groups being arranged on outer sides of the cylinder rows, while the guide rollers in said adjacent double-row drying group being arranged on inner sides of the cylinder rows.

In such a drying end, the fiber web which is to be dried travels in all cases downward through a first vertical row of cylinders in the first drying group (as in FIGS. 2, 5, and 7 of U.S. Pat. No. 3,868,780). The corresponding row of vertical guide rollers always lies on that side of the first vertical row of cylinders which faces the press end. Thus the lower side of the web always comes into contact with the drying cylinders in this first vertical row of cylinders. The important result of this arrangement is that broke which is produced here can drop down unimpeded.

Another important feature of the invention (differing from FIGS. 2, 5, and 7 of the U.S. patent but similar to FIG. 9 of the U.S. patent) is that the lowermost cylinder of the aforementioned first vertical row of cylinders is the last cylinder of the first drying group. This means that the transfer of the web from the support belt of the support belt of the first drying group to the second drying group takes place in the vicinity of said last cylinder, and the web then travels upward through a second vertical row of cylinders in the second drying group. In the second drying group, the upper side of the web comes into contact with the drying cylinders for uniform drying of the web.

It is furthermore important for at least two directly successive drying groups to be arranged as double-row drying groups. For example, the second and the third drying groups or the third and fourth drying groups can be two-row groups. Naturally three (or four) successive drying groups can also be arranged as double-row drying groups. In this arrangement, each of the transfers from one of the drying groups to the following drying group can again be carried out in such a manner that the other side of the web comes into contact with the cylinders in the following drying group.

Another important feature permits all the drying groups, and in particular all the double-row drying groups (differing from FIG. 5, 7 and 8 of the U.S. patent), to be the same height. This is accomplished as follows. In two successive double-row drying groups, the guide-roller rows in one drying group are arranged at the outer sides of the cylinder-rows while the guide-roller rows in the other drying group are arranged at the inner sides of the cylinder row. In other words, in the one drying group the cylinder rows lie between the rows of guide rollers while in the other drying group the guide-roller groups are arranged between the cylinder rows.

One great advantage of the drying end of the invention as compared with traditional drying ends having only horizontal cylinder rows is that the length of the drying end is relatively small (reducing the structural cost of the building). This is true, in particular, when all the drying cylinders are arranged in substantially vertical cylinder rows and, especially, when all the cylinders in the first drying group are arranged in a single, substantially vertical row of cylinders.

However, other factors may also be important. Thus for instance, as explained further below, an individual cylinder of a row of cylinders may advantageously be arranged shifted horizontally out of the vertical row.

Furthermore, it has been found that it may be advantageous if the first drying group is formed of a first substantially horizontal cylinder row and of a substantially vertical cylinder row directly adjacent to it through which the web travels downward. While in this case a slightly greater structural length of the drying end must be tolerated, the following advantages, outweigh this disadvantage: The broke pulper which is present below the press end can be extended toward the drying end, and thus, broke which has possibly been produced at the first drying cylinders can be fed directly into the broke pulper. Furthermore, space is gained for auxiliary devices, pipelines, etc., between the press end and the first vertical cylinder row.

In the drying groups following the first drying group, the danger that the web might tear is naturally substantially less than in the first drying group. Nevertheless, it is advisable to see to it, here also, that any broke produced can be rapidly removed in a downward direction. For this purpose it has been found particularly advantageous to arrange the double-row drying groups in such a manner that in each of these drying groups the web travels upward through the first cylinder row and downward through the second cylinder row. This is explained in detail further below.

BRIEF DESCRIPTION OF THE DRAWINGS

Other objects, features and advantages of the invention will be appreciated in connection with the following detailed description of two non-limiting embodiments thereof, with reference to the accompanying drawings, in which.

DETAILED DESCRIPTION OF THE EMBODIMENTS

Figure 1:
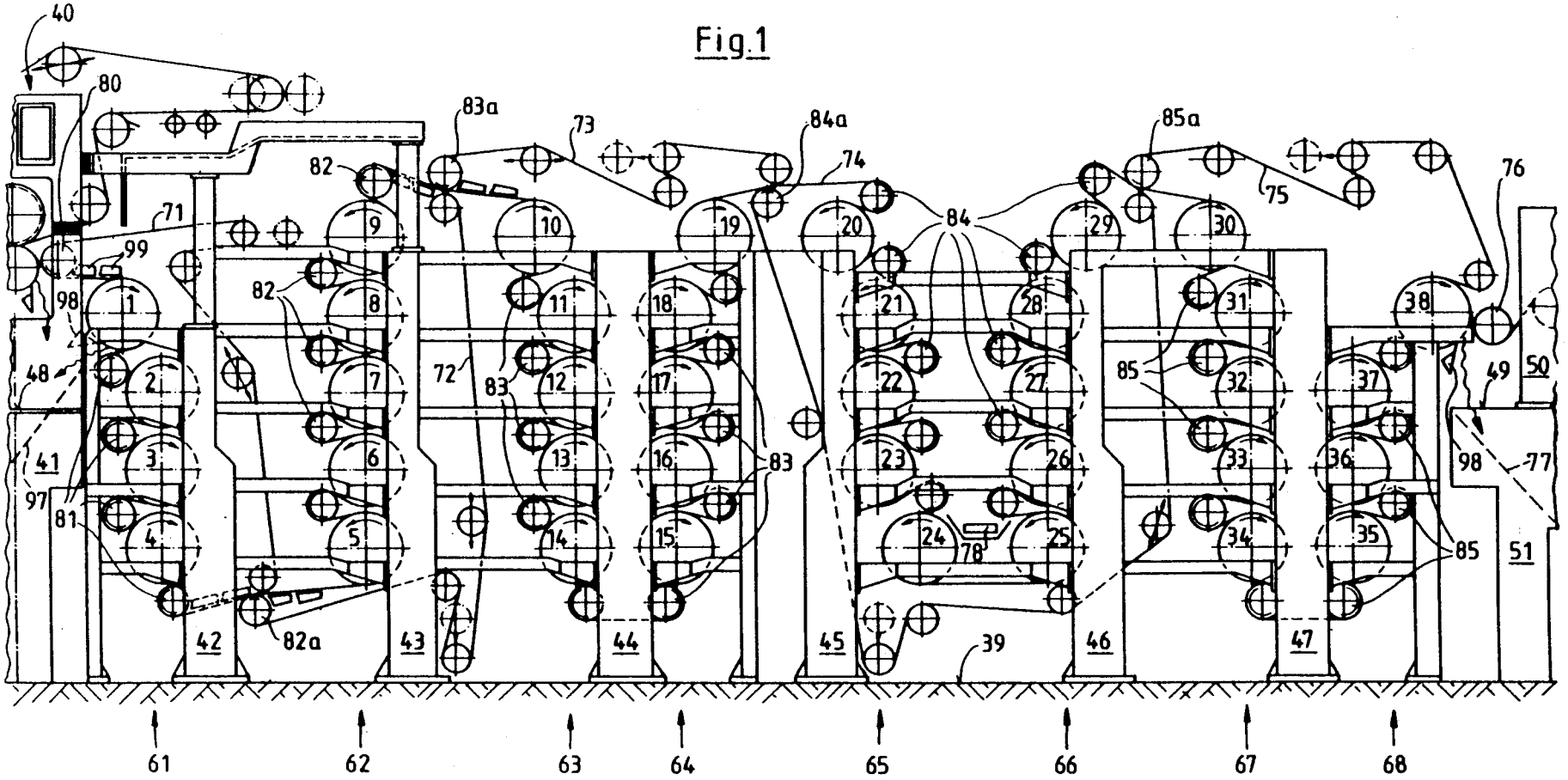
FIGS. 1 and 2 show diagrammatically two embodiments of the invention.

The example of a drying end shown in FIG. 1 comprises a total of eight substantially vertical drying-cylinder rows 61–68, arranged one behind the other. This drying end is part of a paper manufacturing machine. The drying cylinders 1–38 of the drying end are supported mainly on large stands 42–47 which stand directly on the basement floor 39 of a machine building. In addition, smaller vertical supports and longitudinal girders are present, which have not been provided with reference numbers. At the left side of the drawing, part of the press end 40 can be seen, which rests on a concrete base 41. At the right side of the drawing is seen part of a calender 50 which follows the drying end and rests on a concrete base 51. The top sides of the concrete bases 41 and 51 which define the level of the paper machine bottom are designated by 48 and 49 respectively. It can therefore be seen that in the region of the drying end the customary foundations (columns and girders) are not present.

It can furthermore be seen that by arranging the drying cylinders 1–38 in vertical rows, the length of the drying end is made substantially less than with the customary arrangement of the drying cylinders in a single horizontal cylinder row, or in two horizontal cylinder rows lying one above the other.

The first vertical cylinder row 61 comprises four drying cylinders 1–4 and an endless support belt 71. The support belt 71 first travels over a suction guide roller 80 where the support belt takes up the fiber web from the press end 40 and feeds it to the first drying cylinder 1. From here the support belt 71 and the fiber web travel together, over further suction guide rollers 81 alternating with the cylinders 2–4. The side of the web that was originally the lower side contacts the cylinders 1–4. From the lowermost suction guide roller 81 the fiber web, suspended from the bottom of the support belt 71, runs past the stand 42 and is transported in the direction toward the second row of cylinders 62.

The second row comprises five drying cylinders 5–9, a support belt 72 and furthermore six suction guide rollers designated 82 or **82*a*. By means of the lowermost suction guide roller 82*a* which serves as the pickup roller, the second support belt 72 takes up the fiber web from the first support belt 71 and conducts it, in succession, upward over the cylinders 5–9 and over the other suction guide rollers 82. Here the upper side of the web contacts the cylinders 5–9**.

Note that each of the two cylinder rows 61 and 62 forms a drying group in itself. In contrast, the third and the fourth cylinder rows 63, 64 are combined to form a third (double-row) drying group, i e., the ten cylinders 10–19 have a common support belt 73. The support belt 73 conducts the fiber web, starting from the pickup roller 83*a*, first downward over the cylinders 10–14 and then upward over the cylinders 15–19. Within the entire third drying group the lower side of the web always comes into contact with the cylinders. Suction guide rollers 83 are again present between the cylinders 10–15.

In similar fashion, the fifth and sixth cylinder rows 65, 66 form a fourth (also double-row) drying group with a common support belt 74. The latter takes up the web by means of the pickup roller 84*a* and conducts its first downward over suction guide rollers 84 and cylinders 20–24 and then upward over cylinders 25–29. In this connection, the upper side of the web always comes into contact with the drying cylinders Finally, a fifth double-row drying group is provided, comprising the two cylinder rows 67 and 68. A common support belt 75 conducts the paper web, starting from the pickup roller 85*a*, first downward over cylinders 30–34 and then upward over the cylinders 35–38. Between the cylinders, suction guide rollers 85 are again present. From the last cylinder 38 the web passes freely (i.e., without the support belt 75) over a paper guide roller 76 into the calender 50. It is important for the web to pass through the last drying-cylinder row 68 in an upward direction and for the uppermost drying cylinder 38 of this row to lie closer to the calender 50 than the other cylinders 35–37. In this way, the result is obtained that the completely dried web travels away from the last cylinder 38 in downward direction. With this arrangement, if the web temporarily does not reach the calender 50 for some reason, it can drop down freely and will be conducted away over an oblique wall 77 into a broke-pulper, not shown.

In the fourth drying group 65, 66 the suction guide rollers 84 lie between the cylinder rows 65 and 66 and therefore, any broke produced in the fourth group cannot drop freely downward onto the basement floor 39. To correct this problem, a broke conveyer belt 78 which extends transversely through the drying group is provided.

In the first cylinder row 61, the uppermost drying cylinder 1 is shifted horizontally relative to the other cylinders 2–4, namely in the direction toward the press end 40. In this way, the distance between the suction guide roller 80 and the first drying cylinder 1 is shortened, and thus the distance over which the web must hang from the bottom of the support belt 71. The web can be drawn there against the support belt by means of suction boxes 99.

In order to keep the cylinder surfaces clean and to remove any broke produced, scrapers 98 can be arranged on all cylinders. In FIG. 1, such scrapers are shown only on cylinders 1 and 38.

Below the press end 40 there can be noted an oblique wall 97 which serves as a feeder for a broke-pulper (otherwise not shown). This oblique wall 97 is so arranged that it can receive not only the broke produced in the press end 40 but also that produced at the cylinder 1, and conduct it downward.

In the third cylinder row 63 the uppermost drying cylinder 10 is shifted horizontally with respect to the other cylinders 11–14, namely in the direction toward the pickup roller 83*a*, which transfers the web from the second support belt 72 to the third support belt 73. One major advantage with this arrangement is the same as with the shifting of the first cylinder 1. In the fourth cylinder row 64, the uppermost cylinder 19 is also shifted horizontally, namely in a direction toward the place where the web is transferred by means of the pickup roller 84*a* from the support belt 73 to the following support belt 74. In corresponding fashion, the uppermost cylinders 20, 29 and 30 of cylinder rows 65, 66 and 67 are also shifted horizontally relative to the other cylinders.

It can readily be seen, in FIG. 1, that of the support belts 71–75 travels over several guide rollers, including one tensioning roller each, and one adjusting roller each. Furthermore, the press end 40 includes a felt belt with corresponding guide rollers. All of these details are well known in this art and have therefore not been provided with reference numbers in FIG. 1.

The drying end example shown in FIG. 2 again comprises 38 drying cylinders, designated 101–138 Part of the press end 140, having a corresponding base 141, is shown diagrammatically. Also shown is part of the calender frame 150 which rests on a base 151. The guide rollers for the support belts 171–175 are shown merely diagrammatically. An ordinary guide roller is shown as a simple circle, a suction guide roller is shown as a circle containing a dot, and a tensioning roller, for example 170, is shown as a circle with a single-headed arrow. Some of the ordinary guide rollers (191–194) have a double-headed arrow, meaning that they can be shifted in both directions substantially horizontally, as will be discussed further below.

Figure 2:
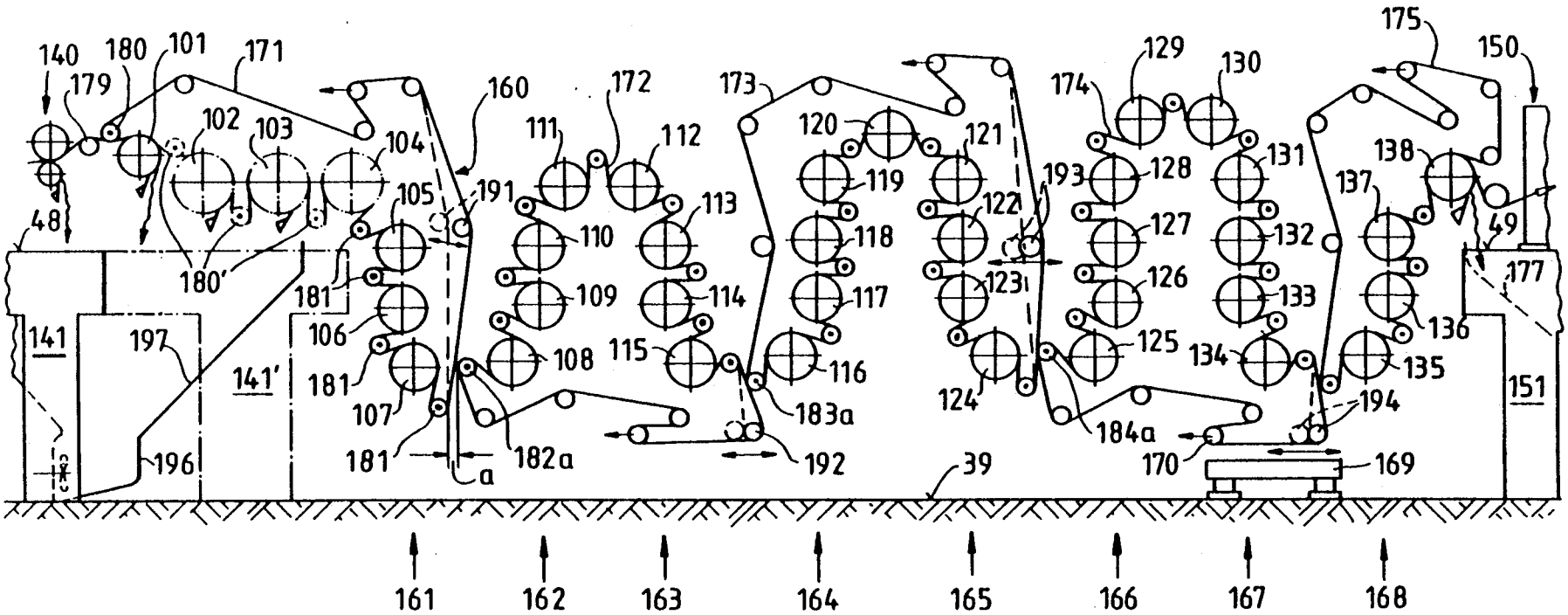

One of the important features of FIG. 2 is that the first drying group comprises a substantially horizontal cylinder row 160 (with the cylinders 101–104) and an adjoining vertical cylinder row 161 (with the cylinders 105–107). The cylinders 101–104 rest on an extension 141' of the press-end base 141. All the other drying cylinders 105–138 are mounted as in FIG. 1 on vertical stands, which have been omitted from FIG. 2. All of these cylinders 105–138 (with the exception of cylinder 120) form essentially vertical cylinder rows which are designated 161–168. Three pairs of cylinder rows, namely the two cylinder rows 162/163, the two cylinder rows 164/165, and the two cylinder rows 166/167, form double-row drying groups, having their own respective support belts 172, 173, 174. Only one single-row drying group 168 is formed, including the last four drying cylinders 135–138 and the support belt 175.

Another important feature of FIG. 2 is that the web passes through the double-row drying groups 162/163, 164/165 and 166/167, in each case, first in the upward direction and then in the downward direction. This has the result that all the transfer places where the web is transferred from one support belt to the following support belt are now in the lower region of the drying end, in contrast to FIG. 1. Specific details of the apparatus provided at these transfer places will now be explained, with particular reference to the example of the transfer place between the first drying group 160/161 and the second drying group 162/163.

From the lowermost drying cylinder 107 in the first group, the support belt 171 travels, together with the web, over the lowermost suction guide roller 181 and from there approximately vertically upward. The support belt runs tangent to the pickup roller 182*a* of the following drying group, which takes up the web from the support belt 171 and transfers it to the support belt 172, whereby the web then travels to the next drying cylinder 108.

On its further path upward, the support belt 171 travels over a guide roller 191 which is displaceable approximately horizontally. The dashed lines show that by displacement of the guide roller 191 in FIG. 2 toward the left, a distance a can be established between the support belt 171 and the pickup roller 182*a*. This arrangement is used to separate the support belt 171 from the pickup roller 182*a* when broke is produced in the region of the drying cylinders 108–111 and is to be removed downwardly. The same type of transfer device is provided between the third drying group 164/165 and the fourth drying group 166/167, namely a transfer device with a horizontally displaceable guide roller 193.

The same principle of transfer, but with downward travelling support belts, is provided at the transfer place between the second drying group 162/163 and the third drying group 164/165, and furthermore at the transfer place from the fourth drying group 166/167 to the last drying group 168. These transfer arrangements include respective horizontally displaceable guide rollers 192 and 194. Each of these displaceable guide rollers is mounted on a respective common frame together with a tensioning roller 170, as shown by way of example at 169.

The transfer of the paper web from the press end 140 to the drying end is effected in FIG. 2 by means of a paper guide roller 179 and the first suction guide roller 180. The distances between the paper guide roller 179 and suction guide roller 180 as well as between the latter and the first drying cylinder 101 are very short, so that the suction boxes 99 preferably included in FIG. 1 can be dispensed with.

Thus, the transfer devices between the drying groups described above have the further advantage, among others, that no suction boxes are required. Furthermore, there is the advantage that no cable guide is necessary for threading the paper web into the drying end. (This applied also to FIG. 1.) As a result of the horizontally displaceable guide rollers 191–194, any broke produced in the entire drying end can be discharged downward without difficulty, so the conveyor belt 78 provided in FIG. 1 can be dispensed with in FIG. 2.

In FIG. 2 there is also shown a broke pulper 196 having an oblique feed wall 197. The latter is so arranged that any broke produced at the cylinders 101–103 passes directly into the broke pulper. Below the calender 150 there is a similar oblique wall 177, which also discharges into a broke pulper.

The cylinders 102–104 of the first drying group and the corresponding suction guide rollers 180', as well as the extension 141' of the base 140, are shown in dot-dash lines. This indicates that the embodiment in accordance with FIG. 2 can be modified by omitting the cylinders 102–104 and suction guide rollers 180' as well as the base extension 141'. In that case, as in FIG. 1, the first drying cylinder 101 would belong to the first vertical cylinder row 161. The entire drying end would, accordingly, be somewhat shorter.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A drying end for a machine for manufacturing fiber webs, wherein:

(a) the drying end comprises a plurality of heatable drying cylinders arranged for form a plurality of drying groups, with at least one guide roller arranged between every two drying cylinders;

(b) each drying group has a respective endless support belt for guiding the fiber web, which travels alternately over the drying cylinders and over the guide rollers so that the fiber web comes into direct contact with the cylinders;

(c) within each drying group, at least some of the drying cylinders are arranged to form a cylinder row which is arranged at least approximately vertically;

(d) in a first drying group having a first support belt and being arranged where the fiber web enters the drying end, the fiber web travels downward through a first substantially vertical cylinder row, a lower side of the web contacting the drying cylinders, and an upper side of the web contacting the first support belt;

(e) in a second drying group having a second support belt and being arranged directly behind the first drying group, the fiber web travels upward through a second substantially vertical cylinder row, the upper side of the web contacting the drying cylinders, and the lower side of the web contacting the second support belt; and (f) the drying end includes at least two directly adjacent double-row drying groups, each said double-row drying group having a respective web support belt, the guide rollers in one of said double-row drying groups being arranged on outer sides of the cylinder rows, while the guide rollers in said adjacent double-row drying group being arranged on inner sides of the cylinder rows.

2. A drying end according to claim 1, wherein all the cylinders in the first drying group are arranged in a single substantially vertical cylinder row.

3. A drying end according to claim 2, further comprising a broke conveyer belt which extends transversely through the drying end below the guide rollers of at least one of the approximately vertical cylinder rows.

4. A drying end according to claim 3, wherein the guide rollers of one of said double-row drying groups are arranged in approximately vertical rows near each other and between the two cylinder rows, and said broke conveyor belt is arranged below said two guide-roller rows.

5. A drying end according to claim 1, wherein the first drying group has a first substantially horizontal cylinder row where the fiber web enters the drying end, and directly adjoining the latter row, is said substantially vertical cylinder row through which the fiber web travels downward.

6. A drying end according to claim 5, wherein the first drying group is followed by one of said double-row drying groups, the fiber web travelling upward through the first cylinder row thereof and downward through the second cylinder row thereof.

7. A drying end according to claim 6, further comprising a last drying group where said fiber web exits from said drying end, and wherein the drying groups between the first and the last drying groups are exclusively double-row drying groups, and the fiber web in each of these double-row drying groups travels upward through the first cylinder row and downward through the second cylinder row.

8. A drying end according to claim 1, wherein each drying group following the first drying group has a suction guide roller which partially supports the endless support belt of said group and is located for serving as a pickup roller for receiving the fiber web from the preceding drying group, the support belt of the preceding drying group being tangent to said suction guide roller.

9. A drying end according to claim 1, wherein at least one of the drying groups has a first drying cylinder which is shifted substantially horizontally out of a substantially vertical cylinder row of said group, in the direction toward a place where the fiber web is received by the support belt of said group.

10. A drying end according to claim 9, wherein said first drying cylinder is shifted in the direction of the pickup roller of said drying group.

11. A drying end according to claim 9, wherein at least one of the drying groups has a last drying cylinder which is shifted substantially horizontally out of a substantially vertical cylinder row of said group, in the direction toward a pickup roller which partially supports the support belt of the following drying group.

12. A drying end according to claim 1, further comprising means for transferring the fiber web from a preceding drying group having a last drying cylinder followed by a last guide roller, to a following drying group having a first drying cylinder and a first guide roller, said means comprising:

(a) means including a substantially horizontally displaceable guide roller for guiding the support belt of the preceding drying group, over said last guide roller, and from the latter, over a substantially vertical travel path, said travel path of the support belt being tangent to and engaging the support belt and first guide roller of the following drying group;

(b) by horizontal displacement of the displaceable guide roller, the support belt of the preceding drying group being movable so as to be spaced from and out of engagement with the first guide roller of the following drying group.

13. A drying end according to claim 12, further comprising a tensioning roller of said preceding drying group, wherein the horizontal displaceable guide roller and said tensioning roller are supported on a common frame.

14. A drying end according to claim 1, further comprising a last drying-cylinder row where the fiber web exits from the drying end, said row being traversed upward by the fiber web, the lower side of the web contacting the drying cylinders of said row; and wherein the uppermost drying cylinder of this last cylinder row is arranged shifted out of said row of cylinders in the fiber web travel direction in such a manner that the fiber web discharges downward from said uppermost cylinder.

15. A drying end according to claim 1, wherein the drying cylinders and guide rollers are mounted on vertical stands which extend at least approximately from a relatively low level of a basement floor on which they are supported, up to at least as high as a pair of relatively higher support bases which precede and follow said drying end for supporting other portions of the paper machine.

* * * * *